US007714823B2

(12) United States Patent
Chen et al.

(10) Patent No.: US 7,714,823 B2
(45) Date of Patent: May 11, 2010

(54) METHOD OF DRIVING LIQUID CRYSTAL DISPLAY PANEL

(75) Inventors: Shyh-Feng Chen, Ji-an Township (TW); Kuei-Sheng Tseng, Bade (TW); Tsung-Cheng Lin, Su-ao Township (TW)

(73) Assignee: AU Optronics Corp., Hsinchu (TW)

( * ) Notice: Subject to any disclaimer, the term of this patent is extended or adjusted under 35 U.S.C. 154(b) by 872 days.

(21) Appl. No.: 11/525,084

(22) Filed: Sep. 22, 2006

(65) Prior Publication Data

US 2007/0222736 A1 Sep. 27, 2007

(30) Foreign Application Priority Data

Mar. 23, 2006 (TW) ..... 95110142 A

(51) Int. Cl.
*G09G 3/36* (2006.01)

(52) U.S. Cl. ..... 345/87; 345/88; 345/90; 345/96; 345/100

(58) Field of Classification Search ..... 345/76, 345/77, 80, 88, 90, 96, 100, 156, 173, 204, 345/589, 32, 87, 98, 211; 349/48, 143, 37, 349/44, 114, 110, 153; 313/500
See application file for complete search history.

(56) References Cited

U.S. PATENT DOCUMENTS 5,977,938 A * 11/1999 Iwasa ..... 345/32
6,414,665 B2 7/2002 Libsch et al.
6,476,787 B1 11/2002 Libsch et al.
6,825,822 B2 11/2004 Lee et al.
6,956,554 B2 * 10/2005 Chen et al. ..... 345/98
6,999,053 B2 2/2006 Lee et al.
7,068,251 B2 * 6/2006 Lin et al. ..... 345/87
7,236,149 B2 * 6/2007 Yamashita et al. ..... 345/76
7,365,714 B2 * 4/2008 Yoo ..... 345/76
7,391,427 B2 * 6/2008 LeBlanc ..... 347/188
2002/0118322 A1 * 8/2002 Murade ..... 349/110
2003/0030609 A1 2/2003 Lee
2003/0030631 A1 * 2/2003 Chen et al. ..... 345/211
2003/0076370 A1 * 4/2003 Hahn ..... 345/961
2003/0169223 A1 9/2003 Lee et al.
2003/0193490 A1 10/2003 Liu et al.
2004/0189577 A1 * 9/2004 Lin et al. ..... 345/98

(Continued)

FOREIGN PATENT DOCUMENTS

CN 1619635 A 5/2005

(Continued)

*Primary Examiner*—Prabodh M Dharia
(74) *Attorney, Agent, or Firm*—Rabin & Berdo, P.C.

(57) ABSTRACT

A liquid crystal display panel includes a first scan line, a second scan line, a data line, a first pixel and a second pixel. The first pixel has a first switch, a second switch and a first pixel electrode. The second pixel has a third switch and a second pixel electrode. The driving method of the liquid crystal display panel includes the following steps. During a first time period, the first scan line and the second scan line are enabled at the same time, and a first pixel voltage is inputted to the data line. During a second time period, the first scan line is enabled, the second scan line is disabled, and a second pixel voltage is inputted to the data line. The second time period is shorter than the first time period.

6 Claims, 6 Drawing Sheets

U.S. PATENT DOCUMENTS

| | | | | |
|---|---|---|---|---|
| 2004/0263057 | A1* | 12/2004 | Uchino et al. | 313/500 |
| 2005/0007357 | A1* | 1/2005 | Yamashita et al. | 345/204 |
| 2005/0083319 | A1 | 4/2005 | Kodate et al. | |
| 2005/0140596 | A1* | 6/2005 | Lee et al. | 345/76 |
| 2005/0264730 | A1* | 12/2005 | Kataoka et al. | 349/114 |
| 2006/0125755 | A1* | 6/2006 | Noguchi et al. | 345/96 |
| 2006/0151745 | A1* | 7/2006 | Kim et al. | 252/301.16 |
| 2006/0232533 | A1* | 10/2006 | Miyazawa | 345/88 |
| 2007/0080905 | A1* | 4/2007 | Takahara | 345/76 |

FOREIGN PATENT DOCUMENTS

| | | |
|---|---|---|
| JP | 5188395 | 7/1993 |
| TW | 523724 | 3/2003 |
| TW | 567463 | 12/2003 |
| TW | 575762 | 2/2004 |
| TW | 580665 | 3/2004 |
| TW | 594630 | 6/2004 |
| TW | 200419227 | 10/2004 |

* cited by examiner

METHOD OF DRIVING LIQUID CRYSTAL DISPLAY PANEL

This application claims the benefit of Taiwan Patent application Serial No. 95110142, filed Mar. 23, 2006, the subject matter of which is incorporated herein by reference.

BACKGROUND OF THE INVENTION

1. Field of the Invention

The invention relates in general to a method of driving a liquid crystal display panel, and more particularly to a method of driving a liquid crystal display panel having dual thin-film-transistor pixels.

2. Description of the Related Art

Referring to FIG. 1, an equivalent circuit diagram of part of the pixels of a conventional liquid crystal display panel is shown. In FIG. 1, for pixels in the same row, every two adjacent pixels share one data line. Take the left pixel LP (m, n) and the right pixel RP (m, n) of FIG. 1 for example. The two pixels, coupled to a scan line $S_{m+1}$ and a data line $D_n$, are respectively positioned at the two sides of the data line $D_n$, and are referred as the left pixel LP (m, n) and the right pixel RP (m, n) hereafter.

The right pixel RP (m, n) is controlled by a thin film transistor M21 and a thin film transistor M22. The gate of the thin film transistor M21 is electrically connected to the scan line $S_{m+1}$, while the source of the thin film transistor M21 is electrically connected to the data line $D_n$. The gate of the thin film transistor M22 is electrically connected to a scan line $S_{m+2}$, while the source of the thin film transistor M22 is electrically connected to the thin film transistor M21. The left pixel LP (m, n) is controlled by a thin film transistor M11 and a thin film transistor M12. The gate of the thin film transistor M11 is electrically connected to the scan line $S_{m+1}$, while the source of the thin film transistor M11 is electrically connected to the data line $D_n$. The gate of the thin film transistor M12 is electrically connected to the scan line $S_m$, while the source of the thin film transistor M12 is electrically connected to the drain of the thin film transistor M11. The pixels on the display panel can be divided into two categories, namely, the left pixels LP and the right pixels RP, according to the position of the pixel with respect to the data line.

Referring to FIG. 2, a timing diagram of the scan signals of the scan lines $S_m$, $S_{m+1}$ and $S_{m+2}$ of the circuit of FIG. 1 is shown. The scanning of the pixels in each row can be divided into two phases of sub-scanning. The first sub-scanning scans all left pixels LP in a row, while the second sub-scanning scans all right pixels RP in the row. For example, when the pixels in the $m^{th}$ row are scanned, at first, during a first time period T1, the scan lines $S_m$ and $S_{m+1}$ are enabled at the same time, meanwhile, the thin film transistors M11 and M12 are turned on at the same time, so a pixel voltage is inputted to the left pixel LP (m, n) via the data line $D_n$. Thus, the first sub-scanning is completed. Then, during a second time period T2, the second sub-scanning is performed. The scan lines $S_{m+1}$ and $S_{m+2}$ are enabled, meanwhile, the thin film transistors M21 and M22 are turned on, so a pixel voltage is inputted to the right pixel RP (m, n) via the data line $D_n$.

Since each pixel has dual thin film transistors, the aperture ratio will be lower than a pixel having one thin film transistor. In order to increase the aperture ratio, another pixel configuration is provided. Referring to FIG. 3, an equivalent circuit diagram of part of the pixels of another conventional liquid crystal display panel is shown. Take the left pixel LP (m, n) and the right pixel RP (m, n) of FIG. 3 for example. The right pixel RP (m, n) is controlled by the thin film transistor M2, the gate of the thin film transistor M2 is electrically connected to the scan line $S_m$, and the first terminal of the thin film transistor M2 is electrically connected to the data line $D_n$. The left pixel LP (m, n) is controlled by the thin film transistor M11 and the thin film transistor M12. The gate of the thin film transistor M11 is electrically connected to the scan line $S_{m+1}$, while the source of the thin film transistor M11 is electrically connected to the data line $D_n$. The gate of the thin film transistor M12 is electrically connected to the scan line $S_m$, while the source of the thin film transistor M12 is electrically connected to the drain of the thin film transistor M11.

Referring to FIG. 4, a timing diagram of the scan signals of the scan lines $S_m$, $S_{m+1}$ and $S_{m+2}$ of the circuit of FIG. 3 is shown. The scanning of the pixels in each row can be divided into two phases of sub-scanning. The first sub-scanning scans all left pixels LP in a row, while the second sub-scanning scans all right pixels RP in the row. For example, when the pixels in the $m^{th}$ row are scanned, at first, during a first time period T1, the scan lines $S_m$ and $S_{m+1}$, are enabled at the same time, meanwhile, the thin film transistors M11 and M12 are turned on at the same time, so a pixel voltage is inputted to the left pixel LP (m, n) via the data line $D_n$. Then, during a second time period T2, only the scan line $S_m$ is enabled in the second phase of sub-scanning, meanwhile, the thin film transistor M2 is turned on, so a pixel voltage is inputted to the right pixel RP (m, n) via the data line $D_n$.

In the conventional practice disclosed above, the enabled time of the scan lines $S_m$ and $S_{m+1}$ during a first time period T1 is equivalent to the enabled time of the scan line $S_m$ during a second time period T2. Therefore, the charge time of the left pixel LP (m, n) is equal to the charge time of the right pixel RP (m, n).

In the liquid crystal display panel disclosed above, every two adjacent pixels in the same row share the same data line. The liquid crystal display panel disclosed above enables a data line to charge two adjacent pixels in the same row by different scan control signals transmitted by serially connected thin film transistors. When the data line charges the pixel electrode of the left pixel LP having dual thin film transistors, the data line signal has to pass through two thin film transistors, so the current charged to the left pixel LP is smaller than the current charged to the right pixel RP. Consequently, the charge ability of the left pixel LP is inferior to the charge ability of the right pixel RP. Thus, when the driving method of FIG. 4 is used, the left pixel LP will be under charged. As a result, proper luminance cannot be achieved, and the image quality of the display is affected.

SUMMARY OF THE INVENTION

It is therefore an object of the invention to provide a method of driving a liquid crystal display panel. By enabling the two adjacent pixels in the same row sharing the same data line to have different lengths of charge time, the under charged problem occurring to the pixels of liquid crystal display panel is resolved, thereby improving image quality of the display.

The invention achieves the above-identified object by providing a method of driving a liquid crystal display panel. The liquid crystal display panel includes a first scan line, a second scan line, a data line, a first pixel and a second pixel. The first pixel has a first switch, a second switch and a first pixel electrode. The second pixel has a third switch and a second pixel electrode. The first terminal of the first switch is coupled to the data line. The control terminal of the first switch is coupled to the second scan line. The first terminal of the second switch is coupled to the second terminal of the first switch. The control terminal of the second switch is coupled to the first scan line. The second terminal of the second switch is coupled to the first pixel electrode. The control terminal of the third switch is coupled to the first scan line. The first terminal of the third switch is coupled to the data line. The second terminal of the third switch is coupled to the second pixel electrode. The driving method includes the following steps. At first, during a first time period, the first scan line and the second scan line are enabled at the same time, and the first pixel voltage is inputted to the data line. The first pixel voltage is transmitted to both the first pixel electrode and the second pixel electrode at the same time. The first pixel voltage corresponds to the first pixel data of the first pixel. Then, during a second time period, the first scan line is enabled, the second scan line is disabled, and the second pixel voltage is inputted to the data line. The second time period is shorter than the first time period. The second pixel voltage is transmitted to the second pixel electrode. The second pixel voltage corresponds to the second pixel data of the second pixel.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 5:
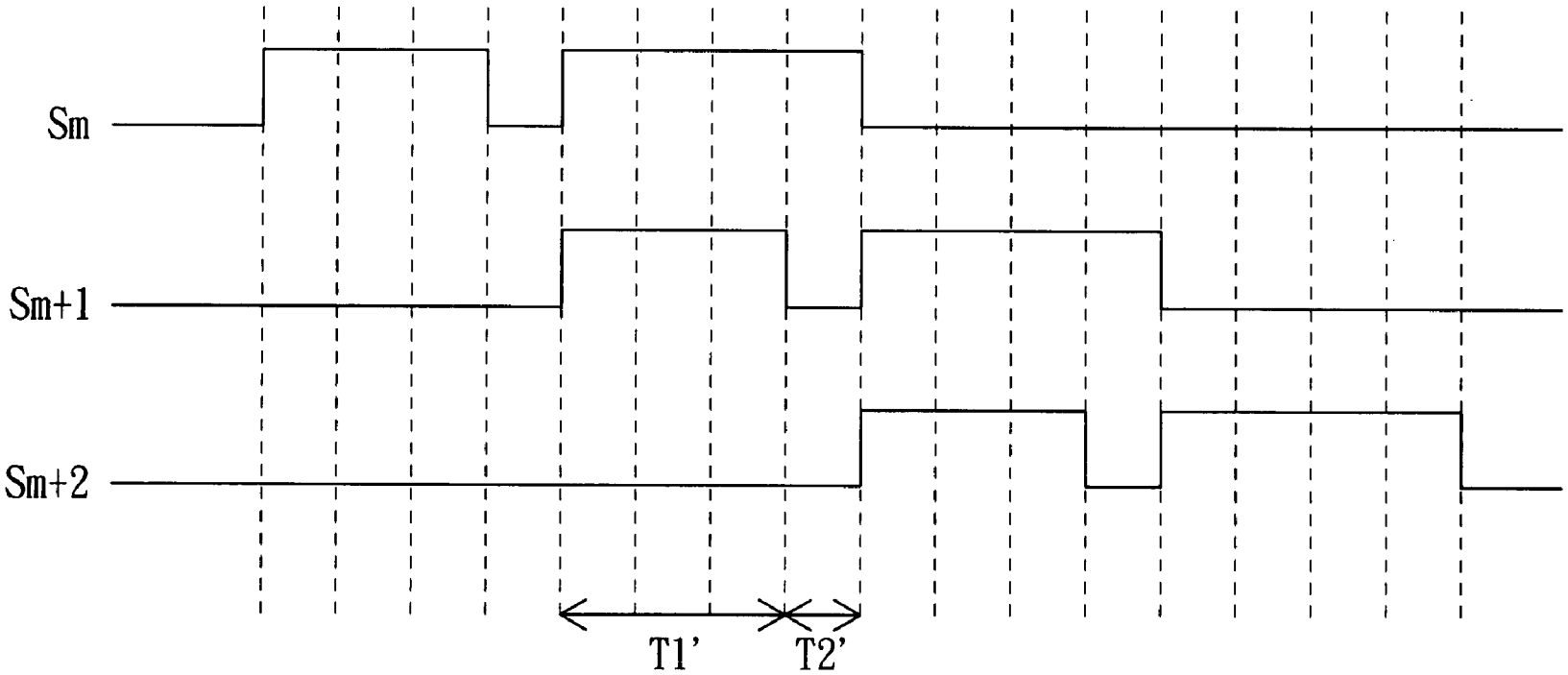
FIG. 5 is a timing diagram of the signals of a liquid crystal display panel driving method according to a preferred embodiment of the invention.
Figure 6:
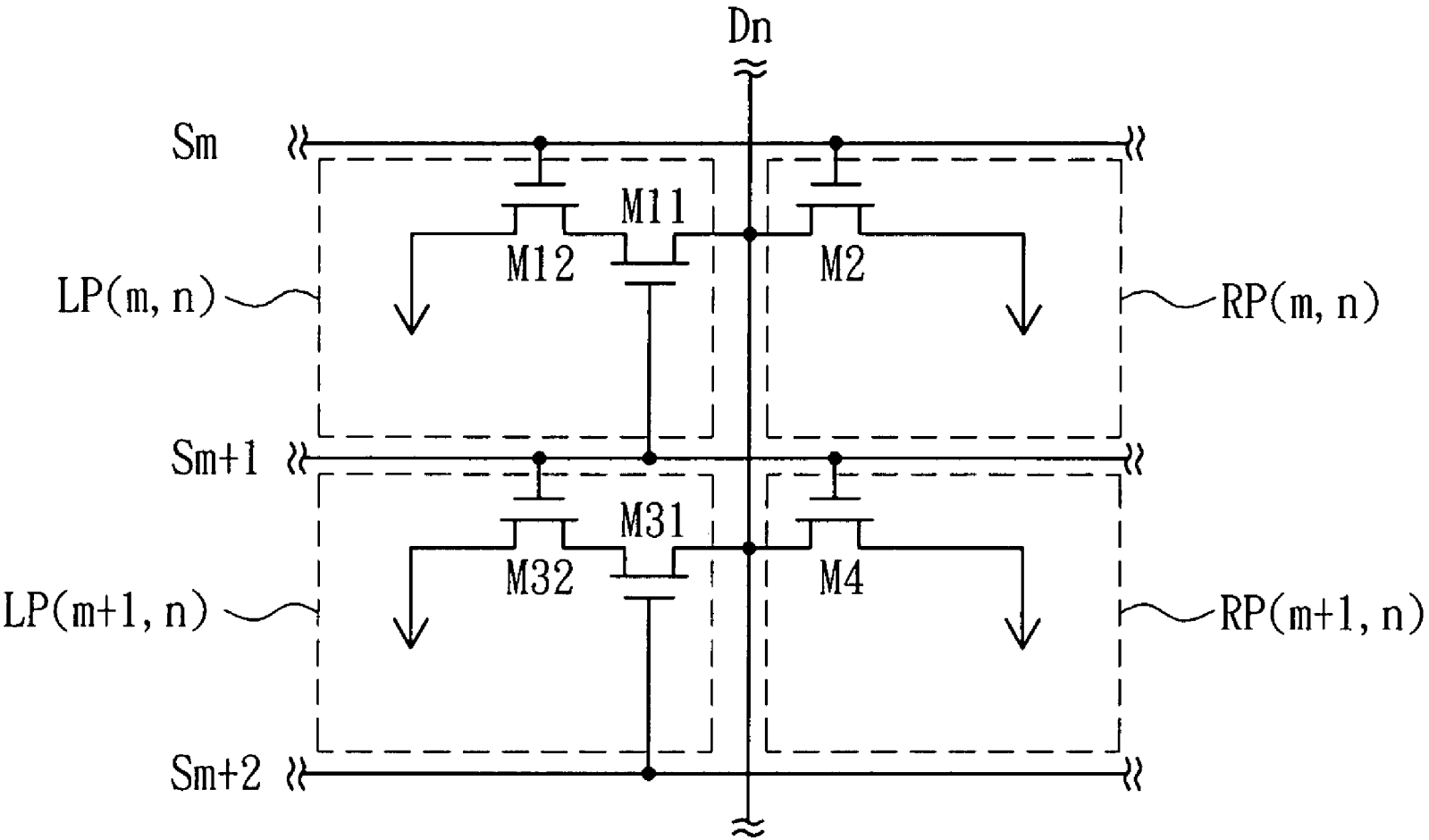
FIG. 6 is an equivalent circuit diagram of part of the pixels of the liquid crystal display panel according to a preferred embodiment of the invention.

Referring to FIG. 5, a timing diagram of the signals of a liquid crystal display panel driving method according to a preferred embodiment of the invention is shown. The driving method of the invention is applicable to the pixel array of FIG. 6. FIG. 6 is an equivalent circuit diagram of part of the pixels of the liquid crystal display panel according to a preferred embodiment of the invention. FIG. 5 is exemplified by the scan signals inputted to the scan lines $S_m$, $S_{m+1}$ and $S_{m+2}$ of FIG. 6. Referring to FIG. 6 at the same time. The scanning of the pixels in each row can be divided into two phases of sub-scanning. The first sub-scanning scans all left pixels LP in a row, while the second sub-scanning scans all right pixels RP in the row. For example, when the pixels in the $m^{th}$ row are scanned, at first, the scan lines $S_m$ and $S_{m+1}$ are enabled during a first time period T1', meanwhile, thin film transistors M11 and M12 are turned on at the same time, so a first pixel voltage is inputted to a left pixel LP (m, n) via a data line $D_n$. Thus, the first phase of sub-scanning is completed. Then, during a second time period T2', the second phase of sub-scanning is performed. Only the scan line $S_m$ is enabled, meanwhile, a thin film transistor M2 is turned on, so the second pixel voltage is inputted to a right pixel RP (in, n) via the data line $D_n$.

It is noteworthy that the first time period T1' is longer than the second time period T2'. That is, the charge time of the left pixel LP (m, n) is longer than the charge time of the right pixel RP (m, n). Thus, the charge time of the left pixel LP (m, n) is prolonged for enabling the left pixel LP (m, n) to have enough time to be charged with sufficient voltage. Thus, the under charged problem occurring to the left pixel LP (m, n) in the conventional practice is resolved.

Furthermore, during the first phase of sub-scanning, the thin film transistor of the right pixel, such as the thin film transistor M2 of the right pixel RP (m, n), is turned on, so the first pixel voltage originally inputted to the left pixel LP is inputted to the right pixel RP. However, during the second phase of sub-scanning, a proper second pixel voltage is inputted to the right pixel RP. During the second phase of sub-scanning, one of the two thin film transistors of the left pixel LP, such as the thin film transistor M12 of the left pixel LP (m, n) is turned on. In the same pixel, the other thin film transistor, such as the thin film transistor M11 that is coupled to the thin film transistor M12, is turned off, so the second pixel voltage to be inputted to the right pixel will not be inputted to the left pixel LP by mistake. Thus, after the scanning of the pixels in a row, the pixel voltage displayed by each pixel in the row is a correct data.

After the scanning of the $m^{th}$ row pixel is completed, the pixels in the $(m+1)^{th}$ row are scanned. The scanning of the $(m+1)^{th}$ row pixel is the same with the scanning of the $m^{th}$ row pixel, and is not repeated here. Thus, each row pixel is scanned one by one, and the driving circuit is able to control each pixel of a display panel.

Besides, when the polarity of the pixel voltage received by the left pixel LP is the same with the polarity of the pixel voltage received by the right pixel RP, the present embodiment of the invention will be most effective. Under the circumstance that the charging polarity of the right pixel RP is the same with the charging polarity of the left pixel LP, when the left pixel LP is charged during the first time period T1', the right pixel RP is charged at the same time to achieve a predetermined voltage value. The pixel voltage received by the left pixel LP and the pixel voltage received by the right pixel RP are closer to each other when the polarity of the left pixel LP is the same with the polarity of the right pixel RP than when the polarity of the left pixel LP is not the same with the polarity of the right pixel RP. Therefore, during the second time period T2', the charge process only needs to supply the shortage of the voltage to the right pixel RP or discharge the right pixel RP to generate a slight voltage drop such that the right pixel RP can achieve the proper voltage value. Despite the right pixel RP has a shorter duration of (charge time, the charge time is enough for the right pixel RP to be charged to the proper voltage.

Figure 1:
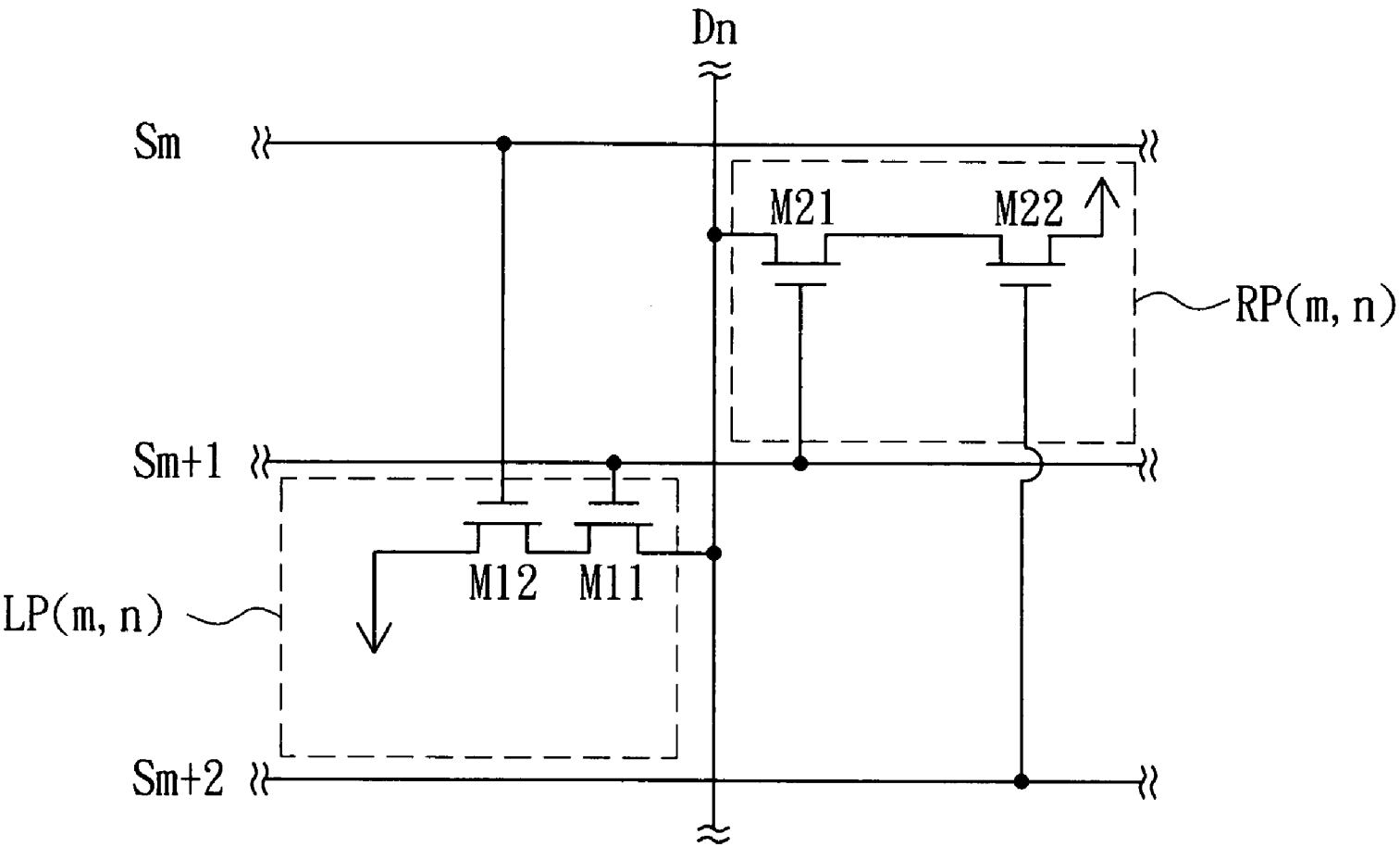
FIG. 1(RELATED ART)
FIG. 1 (Related Art) is an equivalent circuit diagram of part of the pixels of a conventional liquid crystal display panel.
Figure 2:
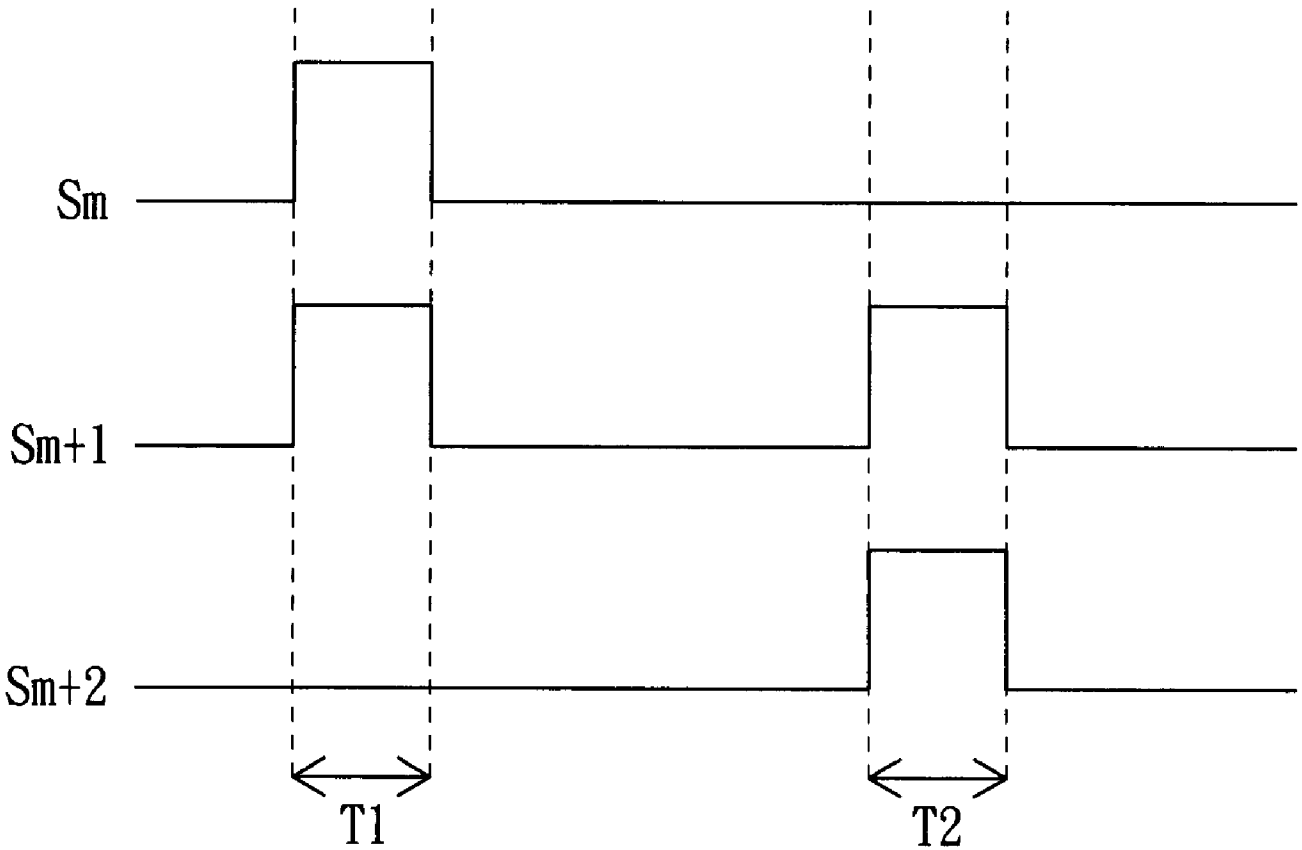
FIG. 2(RELATED ART)
FIG. 2 (Related Art) is a timing diagram of the scan signals of the scan lines $S_m$, $S_{m+1}$ and $S_{m+2}$ of the circuit of FIG. 1.
Figure 3:
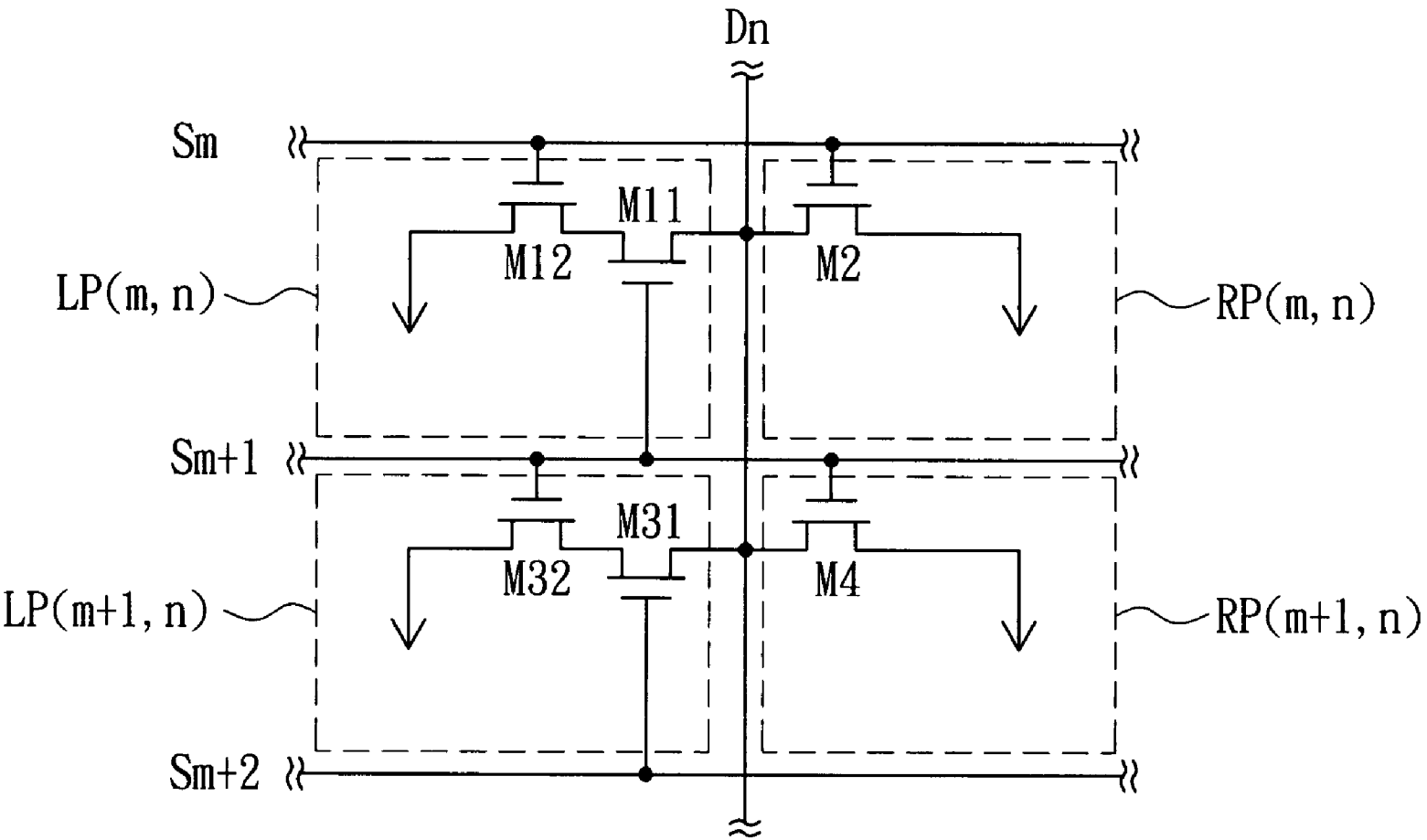
FIG. 3(RELATED ART)
FIG. 3 (Related Art) is an equivalent circuit diagram of part of the pixels of another conventional liquid crystal display panel.
Figure 4:
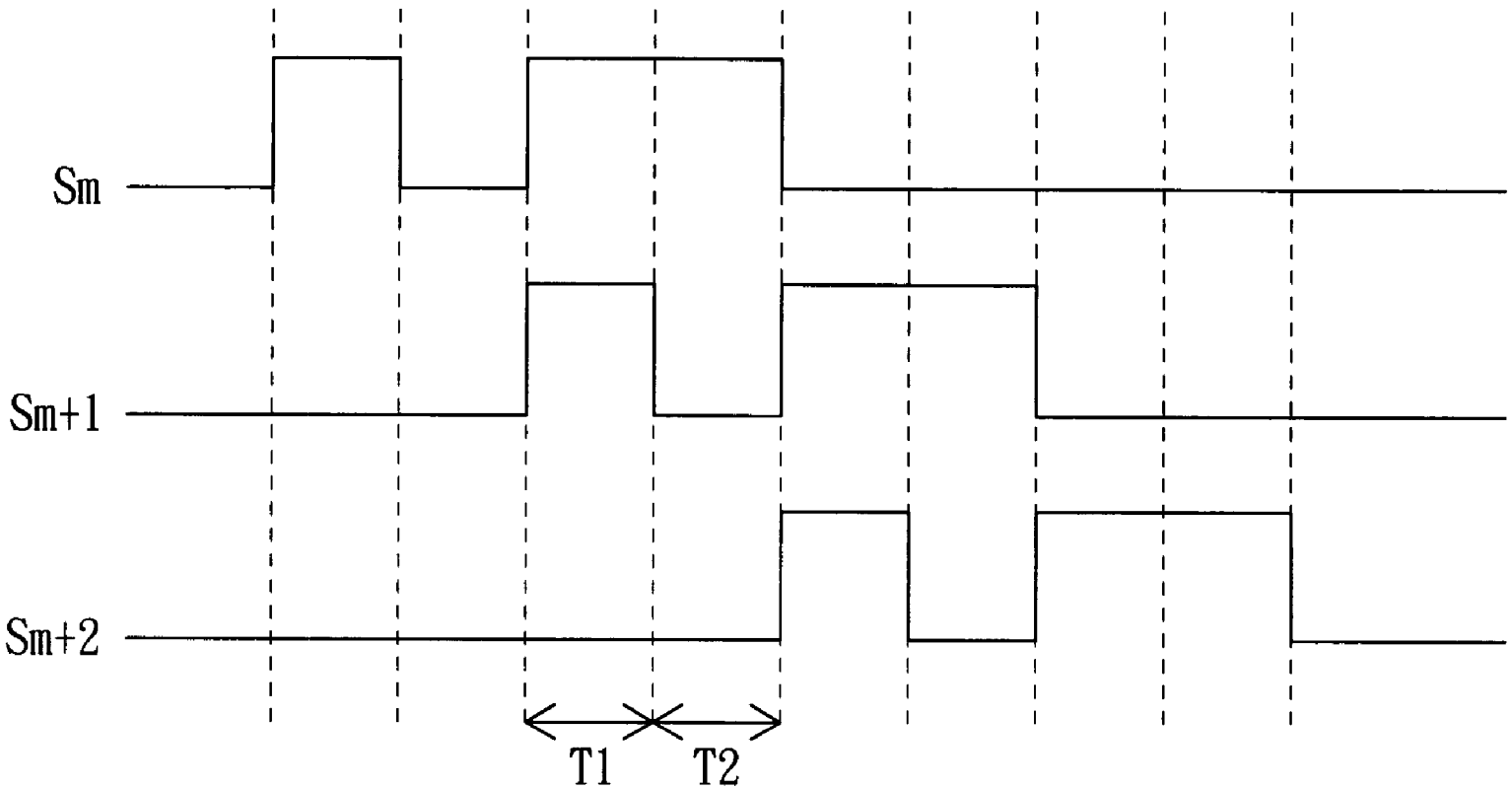
FIG. 4(RELATED ART)
FIG. 4 (Related Art) is a timing diagram of the scan signals of the scan lines $S_m$, $S_{m+1}$ and $S_{m+2}$ of the circuit of FIG. 3.

Under the circumstance when the overall charge time of the pixels in each row is fixed, that is, the sum of the charge time T1' and T2' of FIG. 5 is equal to the charge time T1 and T2 of FIG. 4, the present embodiment of the invention resolves the under charged problem occurring to the left pixel LP. According to the present embodiment of the invention, without increasing the overall charge time of the pixels in each row, both the left pixel LP and the right pixel RP are charged to a proper pixel voltage capable of generating proper luminance.

As for the sequence of driving the left pixel LP and the right pixel RP, either the right pixel RP is driven first or the left pixel LP is driven first will do. Besides, the present embodiment of the invention is also applicable to the configuration in which the left pixel LP has one thin film transistor while the right pixel RP has dual thin film transistors as long as the charge time of the dual thin-film-transistor pixel is longer than the charge time of the single thin-film-transistor pixel.

A method of driving a liquid crystal display panel is disclosed in the above embodiment of the invention. By adjusting the charge time of adjacent pixels which are disposed in the same row and share the same data line, the under charged pixels are compensated, such that the adjacent pixels are all charged to a proper pixel voltage and that the under changed problem occurring to the pixels of a conventional liquid crystal display panel is resolved. The under charged pixels will result in insufficient luminance and deteriorate the image quality of the display. Meanwhile, according to the invention, two pixels use only three thin film transistors, such that a high aperture ratio is maintained.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of driving a liquid crystal display panel comprising a first scan line, a second scan line, a data line, a first pixel and a second pixel, the first pixel has a first switch, a second switch and a first pixel electrode, the second pixel having a third switch and a second pixel electrode, a first terminal of the first switch being coupled to the data line, a control terminal of the first switch being coupled to the second scan line, a first terminal of the second switch being coupled to a second terminal of the first switch, a control terminal of the second switch being coupled to the first scan line, a second terminal of the second switch being coupled to the first pixel electrode, a control terminal of the third switch being coupled to the first scan line, a first terminal of the third switch being coupled to the data line, a second terminal of the third switch being coupled to the second pixel electrode, the driving method comprising:

enabling the first scan line and the second scan line at the same time and inputting a first pixel voltage to the data line during a first time period, the first pixel voltage being transmitted to the first pixel electrode and the second pixel electrode at the same time, the first pixel voltage corresponding to a first pixel data of the first pixel; and enabling the first scan line, disabling the second scan line, and inputting a second pixel voltage to the data line during a second time period, the second time period being shorter than the first time period, the second pixel voltage being transmitted to the second pixel electrode, and the second pixel voltage corresponding to a second pixel data of the second pixel.

2. The driving method according to claim 1, wherein the polarity of the first pixel voltage is the same with the polarity of the second pixel voltage.

3. The driving method according to claim 1, wherein the first scan line of the display panel is substantially parallel to and adjacent to the second scan line, the data line is substantially perpendicular to the first scan line and the second scan line.

4. The driving method according to claim 1, wherein the first switch, the second switch and the third switch of the display panel are thin film transistors (TFTs).

5. The driving method according to claim 4, wherein the thin film transistor of the display panel is an N-type thin film transistor.

6. The driving method according to claim 4, wherein the thin film transistor of the display panel is a P-type thin film transistor.

* * * * *